US009156041B1

(12) United States Patent
Mancinho

(10) Patent No.: US 9,156,041 B1
(45) Date of Patent: Oct. 13, 2015

(54) DIMETHYLMETHYLPHOSPHONATE VAPOR GENERATOR

(75) Inventor: Derek J. Mancinho, Laramie, WY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 575 days.

(21) Appl. No.: 13/465,293

(22) Filed: May 7, 2012

(51) Int. Cl.
*B05B 1/24* (2006.01)
*C06D 3/00* (2006.01)
*F41H 9/06* (2006.01)

(52) U.S. Cl.
CPC ... *B05B 1/24* (2013.01); *C06D 3/00* (2013.01); *F41H 9/06* (2013.01)

(58) Field of Classification Search
CPC ..... C23C 16/4481; C23C 16/4409; C23C 16/4401; C23C 16/4402; H01L 21/67017
USPC ..... 392/386–407
See application file for complete search history.

(56) References Cited

U.S. PATENT DOCUMENTS 2,070,038 A * 2/1937 Batt ..... 516/6
3,069,092 A * 12/1962 Norvell, Jr. ..... 239/133
4,349,723 A * 9/1982 Swiatosz ..... 392/399
4,818,843 A * 4/1989 Swiatosz ..... 392/397
5,870,524 A * 2/1999 Swiatosz ..... 392/394
6,082,714 A * 7/2000 Dornfest et al. ..... 261/142
6,477,890 B1 * 11/2002 Hulsebus ..... 73/40.7
6,494,957 B1 * 12/2002 Suzuki ..... 118/726
7,596,305 B2 * 9/2009 Nelson ..... 392/396
2003/0021595 A1 * 1/2003 Xu et al. ..... 392/400
2006/0081723 A1 * 4/2006 Turberville ..... 239/129
2009/0324206 A1 * 12/2009 Young et al. ..... 392/395
2010/0166955 A1 * 7/2010 Becker et al. ..... 427/248.1
2010/0181387 A1 * 7/2010 Zaffaroni et al. ..... 239/13
2011/0033631 A1 * 2/2011 Malshe et al. ..... 427/459
2011/0054202 A1 * 3/2011 Snow ..... 556/9
2011/0288360 A1 * 11/2011 Puckett et al. ..... 588/299

* cited by examiner

*Primary Examiner* — David Angwin
*Assistant Examiner* — Lawrence Samuels
(74) *Attorney, Agent, or Firm* — Ulysses John Biffoni

(57) ABSTRACT

A DMMP vapor generator, system, and method includes a mixing chamber that receives heated air; at least one heating coil operatively connected to the mixing chamber, wherein the at least one heating coil receives liquid DMMP and uses the heated air to heat the liquid DMMP; a mist sprayer operatively connected to the mixing chamber, wherein the mist sprayer receives the heated liquid DMMP and atomizes the heated liquid DMMP into a DMMP aerosol; and a tube operatively connected to the mixing chamber, wherein the tube receives and vaporizes the DMMP aerosol. The DMMP vapor generator may further include a heater operatively connected to the tube, wherein the heater maintains a temperature in at least a portion of the tube to continue a steady vaporization of the DMMP aerosol. The heated air in the mixing chamber and in the at least a portion of the tube is approximately 195° F.

11 Claims, 6 Drawing Sheets

DIMETHYLMETHYLPHOSPHONATE VAPOR GENERATOR

GOVERNMENT INTEREST

The invention described herein may be manufactured, used, and licensed by or for the United States Government.

BACKGROUND

1. Technical Field

The invention and embodiments described herein generally relate to vapor generators, and, more particularly, to a dimethylmethylphosphonate (DMMP) vapor generator for high output applications.

2. Description of the Related Art

DMMP is used to determine the capacity that gas filters have for filtering toxic nerve agents without using toxic materials. Generally, vaporizing DMMP in large quantities (e.g., 100 cfm or more) has always been difficult and complete vaporization is next to impossible. In the late twentieth century, the concept of spraying DMMP into a length of heated pipe was first explored. Some of the earliest prototypes used an eight foot length of ¾ inch pipe heat traced to 350° F. by solar radiation where the pipe was held at a focal point in an eight foot parabolic trough reflector. Next, DMMP was sprayed into the end of the pipe and the nozzle air carried the DMMP mist through the pipe. The DMMP mist then vaporized before exiting the pipe. Data from this prototype was used later in the fabrication of the DMMP and agent vapor generator used in evaluating the filter developed for the V-22/Osprey vertical takeoff aircraft. One problem with this vapor generator was that the pipe was coiled and immersed in a tank of thermal heat transfer oil, which took hours to preheat.

Conventionally, no off-the-shelf vapor generator exists for vaporizing chemicals as heavy as DMMP which has the consistency of light-weight motor oil. Conventionally, DMMP vapor generators used for testing by the military generally suffer from chemical fallout, that is, not all of the DMMP that was injected into the test system vaporized. Thus, older test systems typically suffered from contamination issues, slow challenge concentration development, and could not be run clean. Most systems in use, utilize a spray nozzle. However, as mentioned above, there is a problem in that not all of the DMMP vaporizes. What does not vaporize stays in an aerosol or drops to the bottom of the test equipment such as a Q262 gas life test machine and must be drained away. Accordingly, a new and improved DMMP vapor generator that overcomes the limitations of the conventional solutions would be beneficial to the industry.

SUMMARY

In view of the foregoing, an embodiment herein provides a DMMP vapor generator comprising a mixing chamber that receives heated air; at least one heating coil operatively connected to the mixing chamber, wherein the at least one heating coil receives liquid DMMP and uses the heated air to heat the liquid DMMP; a mist sprayer operatively connected to the mixing chamber, wherein the mist sprayer receives the heated liquid DMMP and atomizes the heated liquid DMMP into a DMMP aerosol; and a tube operatively connected to the mixing chamber, wherein the tube receives and vaporizes the DMMP aerosol. The DMMP vapor generator may further comprise a heater operatively connected to the tube, wherein the heater maintains a temperature in at least a portion of the tube to continue a steady vaporization of the DMMP aerosol.

The mixing chamber may be housed in a body unit comprising a translucent portion and a screen. The DMMP vapor generator may include a nozzle that discharges atomized DMMP. The heated air in the mixing chamber and in the at least a portion of the tube is approximately 195° F. The DMMP vapor generator may further include a flange that connects the mixing chamber to the tube; and a bifurcated joint inside the mixing chamber and operatively connected to each of the mist sprayer and the flange, wherein the bifurcated joint receives the DMMP aerosol and discharges the heated air from the mixing chamber.

Another embodiment provides a system for vaporizing DMMP comprising a mixing chamber; a pair of heating coils positioned inside the mixing chamber; a first bifurcated joint that distributes liquid DMMP into the pair of heating coils, wherein the pair of heating coils heats the liquid DMMP; an atomizer operatively connected to the mixing chamber, wherein the atomizer atomizes the heated liquid DMMP into a DMMP aerosol; a tube operatively connected to the mixing chamber, wherein the tube receives and vaporizes the DMMP aerosol; and a heater operatively connected to the tube. The heater may maintain a temperature in at least a portion of the tube to continue a steady vaporization of the DMMP aerosol. The mixing chamber may be housed in a body unit comprising a translucent portion and a screen. The system may include a nozzle that discharges atomized DMMP. The temperature in the mixing chamber and in the at least a portion of the tube is approximately 195° F. The system may further include a flange that connects the mixing chamber to the tube; and a second bifurcated joint inside the mixing chamber and operatively connected to each of the atomizer and the flange, wherein the second bifurcated joint receives the DMMP aerosol and discharges the heated air from the mixing chamber.

Another embodiment provides a method of vaporizing DMMP, the method comprising receiving heated air in a mixing chamber; heating liquid DMMP with the heated air; atomizing the liquid DMMP into a DMMP aerosol; outputting the DMMP aerosol into a tube positioned outside of the mixing chamber; and maintaining a steady vaporization rate of the DMMP aerosol in the tube until the DMMP aerosol is completely vaporized. The method may further comprise discharging the vaporized DMMP from the tube. The method may further comprise maintaining the heated air in the mixing chamber and in at least a portion of the tube at approximately 195° F.

These and other aspects of the embodiments described herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION OF PREFERRED EMBODIMENTS

Figure 1A:
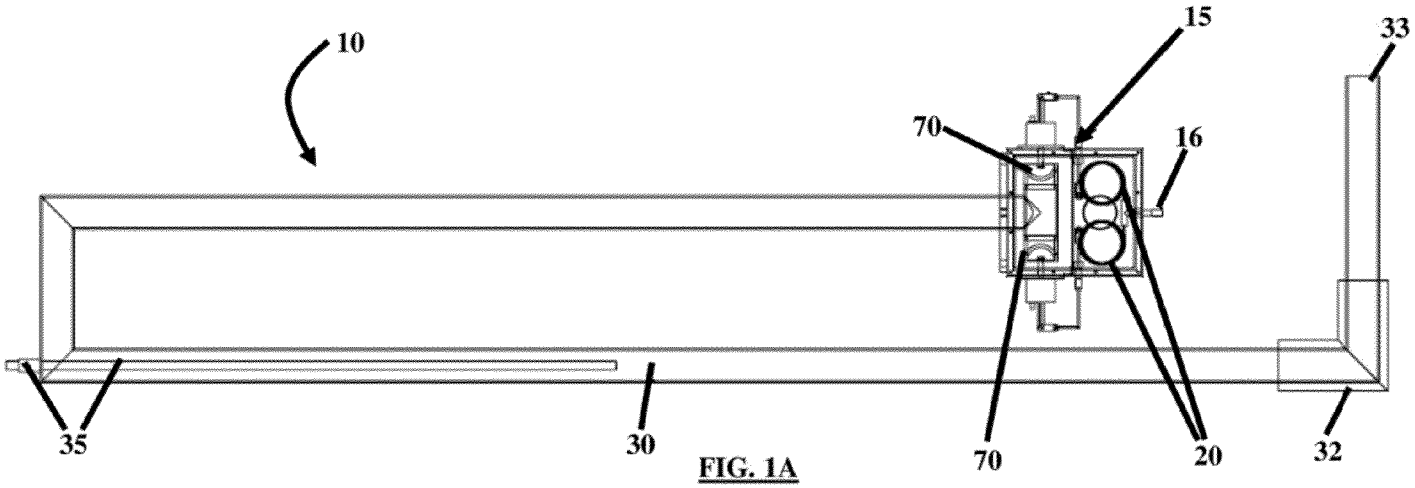
FIG. 1A illustrates a top view of a DMMP vapor generator according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein provide a DMMP vapor generator that vaporizes enough DMMP for testing large (e.g., 100 cfm or more) collective protection gas filters. Referring now to the drawings, and more particularly to FIGS. 1A through 7, where similar reference characters denote corresponding features consistently throughout the figures, there are shown preferred embodiments.

Figure 1C:
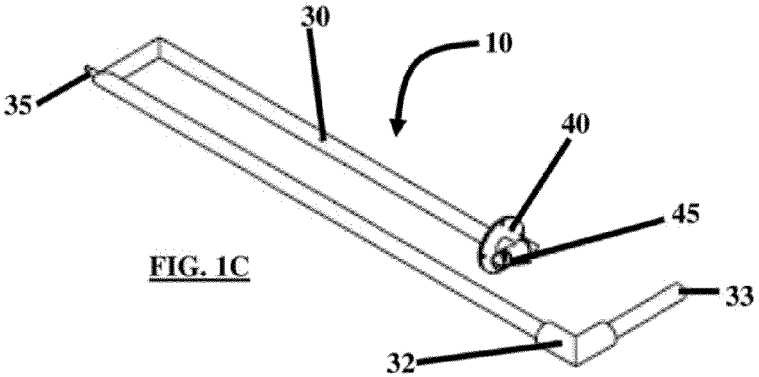
FIG. 1C illustrates a perspective view of a DMMP vapor generator according to an embodiment herein.
Figure 1B:
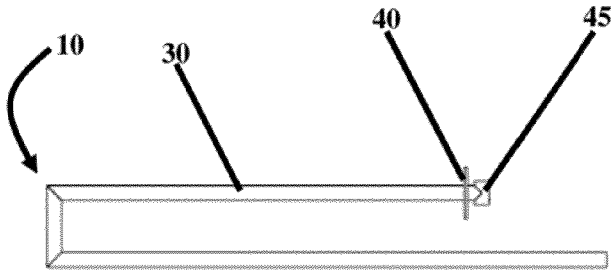
FIG. 1B illustrates an alternate top view of a DMMP vapor generator without a mixing chamber or heater according to an embodiment herein.
Figure 2:
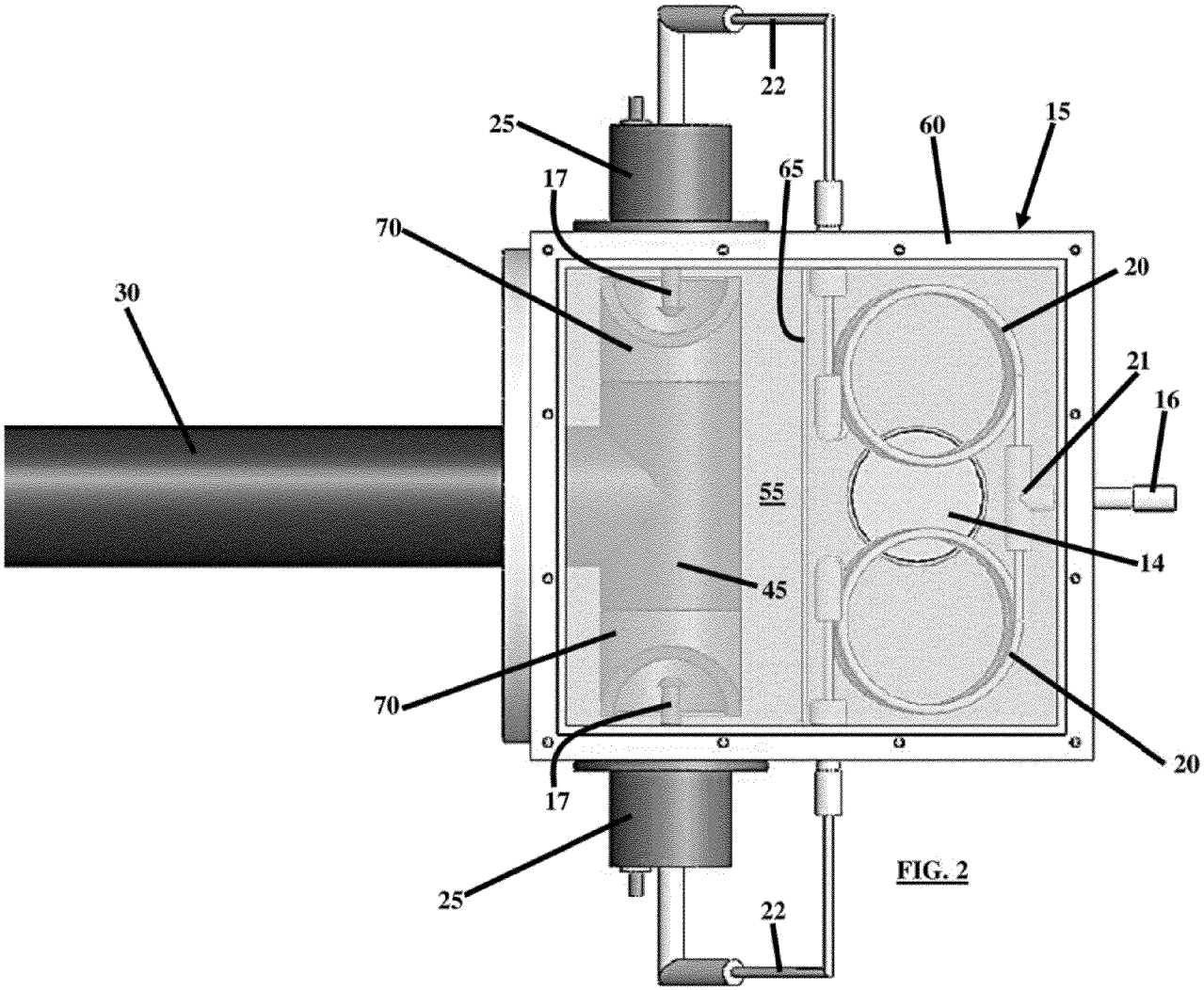
FIG. 2 illustrates a partial magnified top view of a DMMP vapor generator according to an embodiment herein.

A DMMP vapor generator 10 is shown in FIGS. 1A through 2 and comprises a mixing chamber 15 that receives heated air. At least one heating coil 20, which may be embodied as a coiled tube or plurality of coiled tubes, is operatively connected to the mixing chamber 15, wherein the at least one heating coil 20 receives and heats liquid DMMP using the heated air (or other heating source) that enters the mixing chamber 15 through opening 14. The heated liquid DMMP is then delivered to a mist sprayer 25 (e.g., atomizer) and is atomized into a fine aerosol. The air entering opening 14 leaves the mixing chamber 15 through bifurcated joint 45. At this point, the DMMP is in an aerosol state. As the DMMP aerosol is transported through tube 30, the DMMP aerosol is slowly vaporized until it is a complete vapor. The vaporization rate varies depending on the actual temperature in the tube 30 and the droplet size of the DMMP aerosol. Typically, the finer the droplets the more surface area, hence the faster the vaporization rate. As an example, the rate of vaporization for a 500 cfm test filter requires vaporization of approximately 70.8 grams of DMMP per minute.

A heater 35 is operatively connected to the tube 30, wherein the heater 35 maintains a temperature in at least a portion of the tube 30 to continue a steady vaporization of the DMMP aerosol. A flange 40 connects the mixing chamber 15 to the tube 30. The bifurcated joint 45 is positioned inside the mixing chamber 15 and is operatively connected to each of the mist sprayer 25 and the flange 40. The mixing chamber 15 is housed in a body unit 50 comprising a translucent portion 55, a frame 60, and a screen 65. The tube 30 comprises a nozzle 70 that collects the atomized DMMP from the mist sprayer 25 and then discharges the atomized DMMP to the bifurcated joint 45. The heated air in the mixing chamber 15 and in the at least a portion of the tube 30 is approximately 195° F.

Figure 3A:
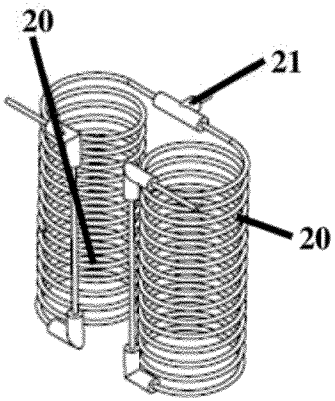
FIG. 3A illustrates a perspective view of a heating coil according to an embodiment herein.
Figure 3B:
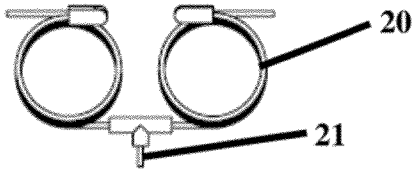
FIG. 3B illustrates a top view of a heating coil according to an embodiment herein.
Figure 3C:
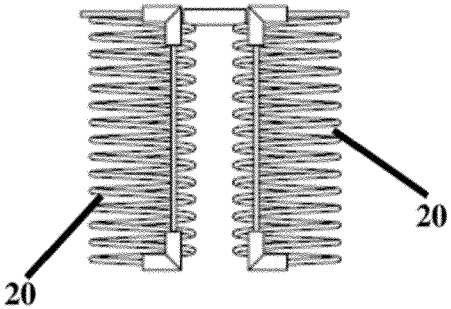
FIG. 3C illustrates a front view of a heating coil according to an embodiment herein.
Figure 4A:
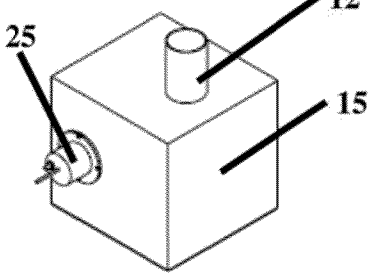
FIG. 4A illustrates a perspective view of a mixing chamber according to an embodiment herein.
Figure 4D:
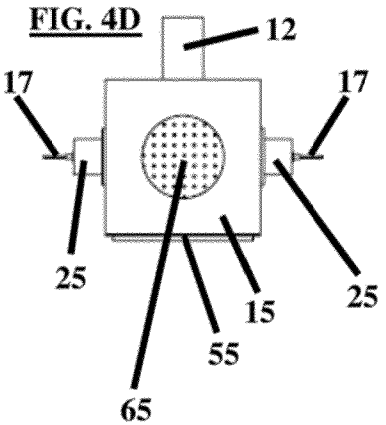
FIG. 4D illustrates a front view of a mixing chamber according to an embodiment herein.
Figure 4B:
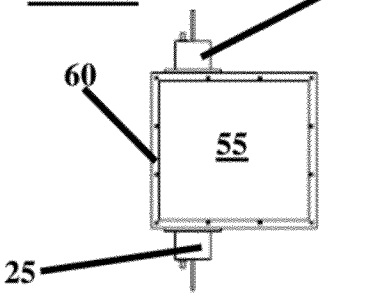
FIG. 4B illustrates a top view of a mixing chamber according to an embodiment herein.
Figure 4C:
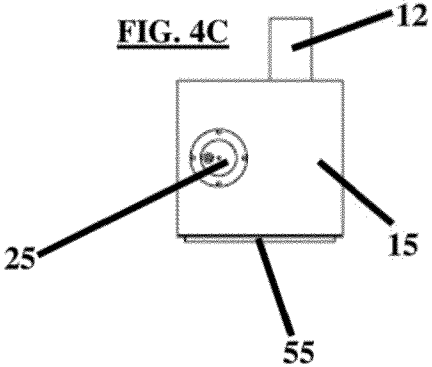
FIG. 4C illustrates a side view of a mixing chamber according to an embodiment herein.
Figure 5:
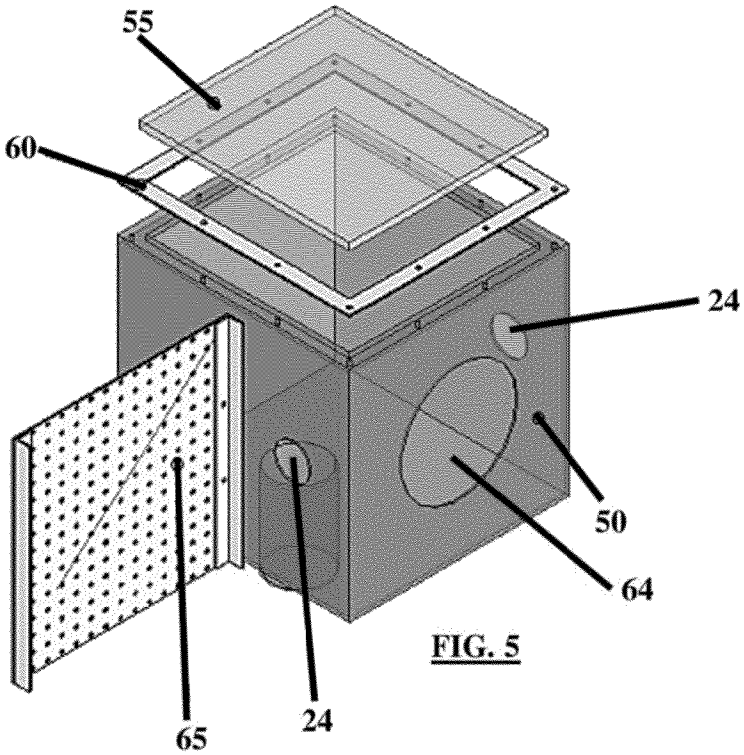
FIG. 5 illustrates a perspective view of a mixing chamber assembly according to an embodiment herein.

FIGS. 3A through 3C illustrate the heating coils 20 in isolation. The heating coils 20 include a tee joint 21 that connects with the fitting 16 (shown in FIG. 2), which allows for the heating coils 20 to receive the liquid DMMP. With respect to FIGS. 4A through 5, the mist sprayers 25 are dimensioned and configured to fit through holes 24 of the body unit 50. Hole 64 of the body unit 50 is dimensioned and configured to accommodate the tube 30 that connects to the bifurcated joint 45. In FIG. 5, the screen 65 is shown positioned outside the body unit 50 for illustration purposes. However, during operation, the screen 65 is positioned inside the body unit 50 (as shown in FIGS. 2 and 4D). The nozzle 70 is further shown in isolation in FIG. 6. The nozzle 70 includes an outer body 71 and an inner portion 72. The outer body 71 includes a sloped top 75 that exposes the inner portion 72. The front portion 74 of the outer body 71 is generally flat and includes a wall portion 73 that partially caps the inner portion 72.

The vapor generator 10 provided by the embodiments herein utilizes the principle of creating a mist of the chemical to be vaporized and transports the mist in a confined and super-heated pipe (e.g., tube 30) until complete vaporization is achieved. According to the embodiments herein, air is heated and blown into a length of insulated pipe (e.g., tube 30). The liquid DMMP is initially heated by pumping (e.g., using a metering, pump (not shown)) it through the heating coils 20 prior to atomization. Because a blower (not shown, but a blower may be positioned adjacent to the mixing chamber 15) is used, airless mist sprayers 25 may also be used according to one embodiment. Preheating the DMMP prior to injection to the mist sprayers 25 and heating the airflow directly allows the DMMP to be vaporized in the tube 30 at a much lower temperature of 195° F. compared with the conventional designs, which is below the flash point of DMMP (e.g., 200° F.). To meet the standard test requirement of 5000 mg/m3 of DMMP to be delivered to a test filter (not shown) at 125° F., the DMMP concentration in the vapor generator 10 is much higher due to the lower flow within the vapor generator 10 which is approximately 35 cfm. This concentrated air/vapor mix is then mixed with air flow ranging from approximately 100 to 1000 cfm. Because the DMMP is vaporized in a separate vapor generator 10 (e.g., separate from a main test system (not shown)) the main test flow can be maintained at a much lower temperature.

The high temperatures within the vapor generator 10 allow for an almost instant loss of vapor upon cessation of DMMP liquid injection as well as instantaneous concentration of choice upon initiation of feed. In other words, the DMMP gas life test is a very exacting and sensitive test. With a feed concentration of approximately 5000 mg $m^3$ and a maximum concentration exiting the test filter of approximately 0.04 $mg/m^3$, the difference between the concentrations is approximately 125,000 times. At the end of a filter test if the feed concentration does not immediately drop to zero, then contamination of the test system downstream of the test filter will occur when the filter is removed from the system. This contamination can delay testing for several days. Therefore, it is desirable that upon cessation of DMMP injection into the vapor generator 10, the concentration drops off instantly. Also, to determine the exact time at which the test is initiated it is also desirable that the target concentration (approximately 5000 mg/m$^3$) is reached instantly rather than ramping up over 30 minutes or more. The standard gas life test is approximately 120 minutes from initiation of the 5000 mg/m$^3$ challenge until the 0.04 mg/m$^3$ concentration is detected exiting the test filter. The lab may test as many as four to five filters in a day, therefore instant delivery of a test challenge and instant clearing of the challenge is very desirable, which the vapor generator 10 provided by the embodiments herein achieves. Additionally, since none of the DMMP drops out of the system and is collected by the test filter, an actual weight balance can be achieved. Generally, prior to the development of the vapor generator 10, the conventional solutions have not been able to successfully accomplish this.

Heating the air entering the vapor generator 10 heats the air directly and when combined with the pre-heat coils 20 allows the vapor generator 10 to vaporize DMMP while staying below the material's flash point (e.g., 200° F.). The vapor generator 10 reaches an operating temperature within approximately one hour. Since all of the DMMP that is fed to the vapor generator 10 is vaporized, the calibration of the detection equipment can be checked against the amount of DMMP injected for each and every test. The mixing chamber 15 is used to hold the mist sprayers 25 (e.g., atomizers) in place and may have a translucent portion 55 (e.g., glass) that allows viewing of the tips 17 of the mist sprayers 25 (e.g., atomizers) when in operation and allows easy access for maintenance.

As mentioned above, the liquid DMMP is metered into the mixing chamber coils 20 located inside the mixing chamber 15 where it is preheated by the 35 cfm of heated air entering the bottom of the mixing chamber 15 through tube 12 of the mixing chamber 25. The DMMP then leaves the mixing chamber coils 20 and is fed into the back of the mist sprayers 25 (e.g., atomizers) through tubes 22. The atomized DMMP exits the tips 17 of the mist sprayers 25 and is drawn into the approximately two inch (for example) tee joint 45 along with the heated air exiting the mixing chamber 15. The tips of the tee joint 45 are configured to draw off the atomized DMMP that exits the mist sprayers 25 (e.g., atomizers) and any liquid DMMP that spatters or drips from the tips 17 of the mist sprayers 25. Although the air entering the mixing chamber 15 is heated to about 195° F., the temperature in the first length of the pipe (e.g., tube 30) exiting the mixing chamber 15 cools due to the vaporization of the liquid DMMP. The heater 35 in the final length of the tube 30 maintains 195° F. to continue the vaporization of the DMMP aerosol and entrained DMMP liquid. This results in the full vaporization of the liquid DMMP that is fed into the main test system (not shown). This 35 cfm of hot DMMP vapor in air mixture is then fed into a main test system (not shown) that connects to the end 33 (near elbow 32) of the tube 30 such as a Q262 filter test system and is mixed with the system's primary air.

Figure 7:
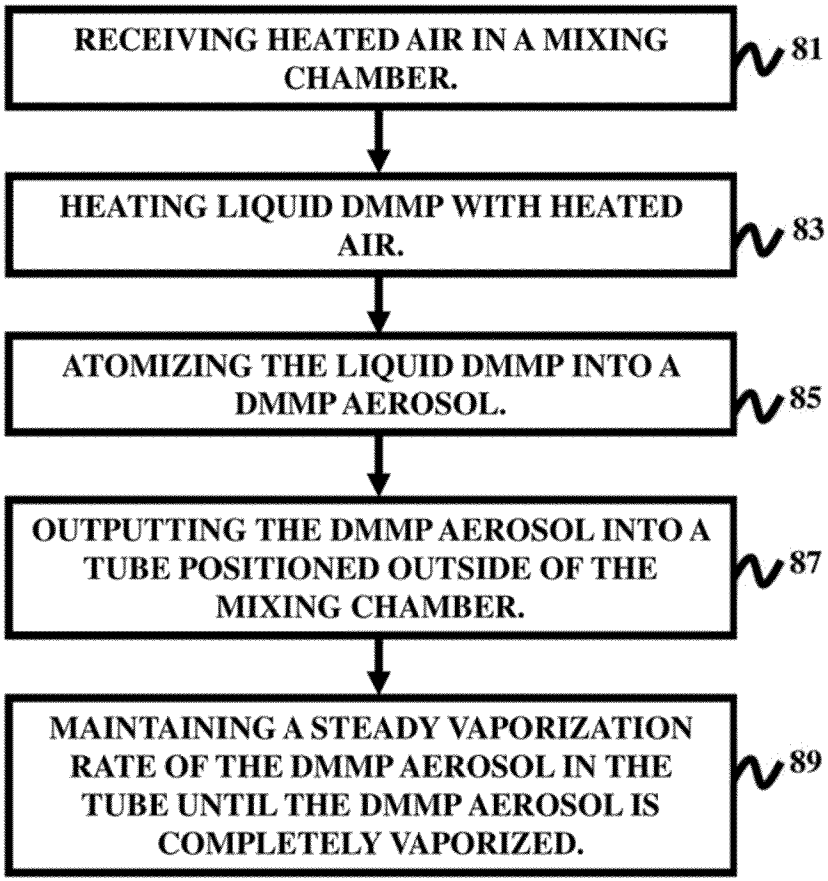
FIG. 7 is a flow diagram illustrating a preferred method according to an embodiment herein.
Figure 6:
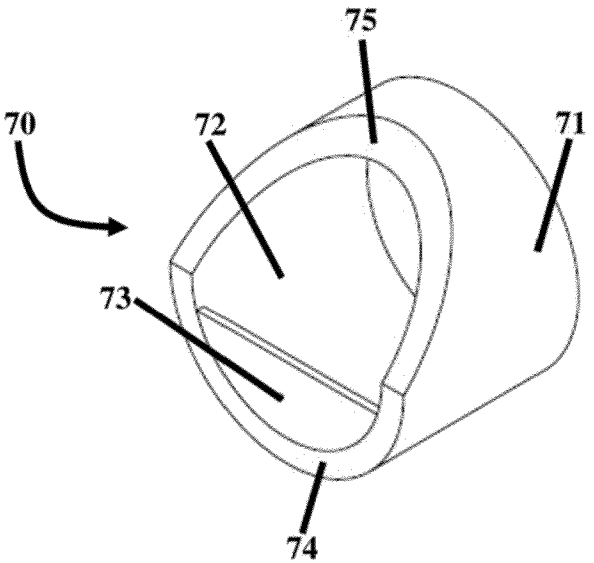
FIG. 6 illustrates a perspective view of an adapter according to an embodiment herein.

FIG. 7, with reference to FIGS. 1A through 6, is a flow diagram illustrating a method of vaporizing DMMP according to an embodiment herein. The method comprises receiving (81) heated air in a mixing chamber 15; heating (83) liquid DMMP with the heated air; atomizing (85) the liquid DMMP into a DMMP aerosol; outputting (87) the DMMP aerosol into a tube 30 positioned outside of the mixing chamber 15; and maintaining (89) a steady vaporization rate of the DMMP aerosol in the tube 30 until the DMMP aerosol is completely vaporized. The method may further comprise discharging the vaporized DMMP from the tube 30. The method may further comprise maintaining the heated air in the mixing chamber 15 and in at least a portion of the tube 30 at approximately 195° F.

The embodiments herein provide a DMMP vapor generator 10 that provides complete vaporization and also allows a test system (not shown) to reach the targeted vapor concentration quickly as well as permitting the system to be cleared quickly. The capability of a vapor to clear itself quickly is also beneficial in that low test concentrations can be conducted and contamination issues are less of a problem.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A dimethylmethylphosphonate (DMMP) vapor generator, comprising:

a mixing chamber that receives heated air;

a pair of heating coils positioned inside said mixing chamber, wherein said pair of heating coils receives liquid DMMP and uses said heated air to heat said liquid DMMP;

a pair of mist sprayers operatively connected to said mixing chamber, wherein each of said pair of mist sprayers receives the heated liquid DMMP from one of said pair of heating coils and atomizes said heated liquid DMMP into a DMMP aerosol;

a tube operatively connected to said mixing chamber, wherein said tube receives and vaporizes said DMMP aerosol, said tube having a heater operatively connected to said tube, wherein said heater maintains a temperature in at least a portion of said tube to continue a steady vaporization of said DMMP aerosol; and a bifurcated joint inside said chamber and operatively connected to each of said mist sprayers, wherein said bifurcated joint receives said DMMP aerosol from each of said mist sprayers and, also discharges said DMMP aerosol and said heated air from said mixing chamber into said tube.

2. The vapor generator of claim 1, wherein said mixing chamber is housed in a body unit comprising:

a translucent portion; and a screen.

3. The vapor generator of claim 1, further comprising a nozzle that discharges atomized DMMP into said bifurcated joint.

4. The vapor generator of claim 1, wherein said heated air in said mixing chamber is approximately 195° F.

5. The vapor generator of claim 1, wherein said temperature in said at least a portion of said tube is approximately 195° F.

6. A system for vaporizing dimethylmethylphosphonate (DMMP), comprising:

a mixing chamber receiving heated air;

a pair of heating coils positioned inside said mixing chamber;

a first bifurcated joint that distributes liquid DMMP into said pair of heating, coils, wherein said pair of heating coils heats said liquid DMMP;

a pair of atomizers operatively connected to said mixing chamber and each of said atomizers receiving liquid DMMP from one of said pair of heating coils, wherein said atomizers atomizes said heated liquid DMMP into DMMP aerosol;

a tube operatively connected to said mixing chamber, wherein said tube receives and vaporizes said DMMP aerosol;

a heater operatively connected to said tube; and a second bifurcated joint positioned inside said mixing chamber and operatively connected to each of said atomizers, wherein said second bifurcated joint receives said DMMP aerosol from each of said atomizers and also discharges said DMMP aerosol and said heated air from said mixing chamber into said tube.

7. The system of claim 6, wherein said heater maintains as temperature in at least a portion of said tube to continue a steady vaporization of said DMMP aerosol.

8. The system of claim 6, wherein said mixing chamber is housed in a body unit comprising:

a translucent portion; and a screen.

9. The system of claim 6, further comprising a nozzle that discharges atomized DMMP.

10. The system of claim 6, wherein a temperature in said mixing chamber is approximately 195° F.

11. The system of claim 7, wherein said temperature in said at least a portion of said tube is approximately 195° F.

* * * * *